US005899820A

United States Patent [19]

Minematsu et al.

[11] Patent Number: 5,899,820

[45] Date of Patent: May 4, 1999

[54] GOLF CLUB HEAD AND METHOD OF MANUFACTURING THEREOF

[75] Inventors: Hideharu Minematsu; Yasuto Imai, both of Tokyo, Japan

[73] Assignee: Daiwa Seiko, Inc., Tokyo, Japan

[21] Appl. No.: 08/937,807

[22] Filed: Sep. 25, 1997

[30] Foreign Application Priority Data

Sep. 25, 1996 [JP] Japan ..... 8-253294

[51] Int. Cl.[6] ..... A63B 53/04

[52] U.S. Cl. ..... 473/329; 473/342; 473/350

[58] Field of Search ..... 473/329, 342, 473/345, 349, 350

[56] References Cited

U.S. PATENT DOCUMENTS 1,463,533 7/1923 Kurz, Jr. ..... 473/342
5,407,202 4/1995 Igarashi ..... 473/342
5,683,310 11/1997 Chen ..... 473/349
5,720,673 2/1998 Anderson ..... 473/342

FOREIGN PATENT DOCUMENTS 5-337222 12/1993 Japan .
6-182006 7/1994 Japan .

*Primary Examiner*—Kien T. Nguyen
*Attorney, Agent, or Firm*—Longacre & White

[57] ABSTRACT

In a manufacturing method of a golf club head, when a portion close to the outer edge of the inserting end of the face body is press-fitted and inserted into the recess being plastically deformed along the bottom section of the recess, the probability of occurrence of blow holes in the dented section formed in the recess is low compared with the conventional head body; the engaging strength of the face body with the recess of the head body is enhanced compared with the conventional head body; and further it is easy to manufactured the club head.

10 Claims, 2 Drawing Sheets

GOLF CLUB HEAD AND METHOD OF MANUFACTURING THEREOF

BACKGROUND OF THE INVENTION

The present invention relates to a golf club head in which a metallic face body is press-fitted into a recess formed on a ball hitting surface of a face section of a metallic head body. Also, the present invention relates to a method of manufacturing the golf club head.

The above golf club head and the method of manufacturing the golf club head are disclosed, for example, in Japanese Unexamined Patent Publication Nos. 5-337222 and 6-182006.

In the golf club head disclosed in Japanese Unexamined Patent Publication No. 5-337222, on the inner circumferential surface of the recess formed on the ball hitting surface of the face section of the metallic head body, there is provided a dented section composed of a linear inclined surface protruding outward as it comes from the opening edge of the recess to the rear surface of the head body. In the above dented section, at a position closest to the rear surface of the head body, there is formed a bottom section protruding inward from the opening edge.

When the conventional golf club head is manufactured, the metallic face body is press-fitted into the recess of the head body. Due to the foregoing, a portion close to the outer edge portion of the inserting end of the face body is plastically deformed along the bottom section of the recess. When the inserting end of the face body enters the recess in this way, the metallic face body can be engaged with the recess.

In the golf club head disclosed in Japanese Unexamined Patent Publication No. 6-182006, on the inner circumferential surface of the recess formed on the ball hitting surface of the face section of the metallic head body, there is provided a dented section including an engaging section once dented outward from the opening edge of the recess and a perpendicular extending section which extends substantially perpendicularly to the ball hitting surface toward the rear surface of the head body. Further, in the above dented section, at a position closest to the rear surface of the head body, there is provided a bottom section protruding inward from the opening edge. Furthermore, in a portion close to the outer edge of the inserting end of the metallic face body press-fitted into the recess of the head body, there is provided a protrusion which protrudes substantially perpendicularly to the ball hitting surface of the face body.

In the case of manufacturing the conventional golf club head, when the metallic face body is press-fitted into the recess of the head body, a protrusion in the portion close to the outer edge at the inserting end of the face body is plastically deformed in such a manner that the protrusion is bent along the bottom section of the recess. In this way, the protrusion enters the recess so as to attain the engagement with the recess.

In the golf club head disclosed in Japanese Unexamined Patent Publication No. 5-337222, a portion close to the outer edge of the inserting end of the face body enters the dented section in such a manner the portion is plastically deformed along the bottom section of the recess of the head body. First, this portion close to the outer edge of the inserting end of the face body fills a region in the recess close to the bottom section which is most distant from the opening end of the recess. Then, the portion comes toward the opening edge along the inner circumferential surface of the recess. When the portion gradually comes inward, it comes close to the opening edge. In this way, the portion close to the outer edge of the inserting end of the face body fills the residual region of the dented section. The portion close to the outer edge of the inserting end of the face body, which has been plastically deformed along the bottom section of the recess of the head body, finally reaches a region close to the opening edge of the recess in the process of the above plastic deformation. Accordingly, blowholes tend to occur in a region close to the opening edge of the recess. When a large number of blow holes are generated, an abnormal sound is caused in the case of hitting a golf ball with the ball hitting surface of the face body. Further, there is a possibility that the original performance of the face body can not be exhibited and the face body comes off from the recess of the head body. For the above reasons, when a large number of blow holes are found in the above region in the process of final inspection conducted in the process of manufacturing the golf club head, the golf club head is thrown into the discard.

In the golf club head disclosed in Japanese Unexamined Patent Publication No. 6-182006, a protrusion in the portion close to the outer edge of the inserting end of the face body is plastically deformed and fed into the above dented section along the protrusion in the recess of the head body. Accordingly, the mechanical strength of the protrusion, which has been plastically deformed, is so low that the engaging strength of the face body with respect to the recess of the head body is low. When the protrusion is previously formed in the portion close to the outer edge of the inserting end of the face body, it requires a complicated work in the process of manufacturing the golf club head.

SUMMARY OF THE INVENTION

The present invention has been accomplished in the above circumstances. It is an object of the present invention to provide a golf club head and a manufacturing method thereof characterized in that: when a portion close to the outer edge of the inserting end of the face body is press-fitted and inserted into the recess being plastically deformed along the bottom section of the recess, the probability of occurrence of blow holes in the dented section is low compared with the conventional head body; the engaging strength of the face body with the recess of the head body is enhanced compared with the conventional head body; and further it is easy to manufactured the golf club head.

In order to accomplish the above objects, the present invention is to provide a golf club head in which a recess is formed on a ball hitting surface of a face section of a metallic head body and a metallic face body is press-fitted into the recess, the golf club head comprising: a dented section including an engaging section formed in at least one portion on the inner circumferential surface of the recess in such a manner that the engaging section is once dented outward with respect to the edge of the opening of the recess, the dented section also including an inclined section which is inclined inward as it comes to a rear surface of the head body; and a bottom section protruding in the dented section at a position closest to the rear surface of the head body inward with respect to the edge of the opening of the recess, wherein the face body press-fitted into the recess is plastically deformed along the bottom section and the inclined section formed in the dented section so that the face body can be engaged with the engaging section of the dented section.

In the golf club head according to the invention, the composition of which is described above, when a portion close to the outer edge of the inserting end of the face body is inserted into the dented section being plastically deformed along the bottom section of the recess, first, it fills a region close to the bottom section which protrudes to a portion close to the opening edge of the recess. Then, as the portion comes toward the opening edge of the recess along the inclined portion of the dented section, it fills the residual region of the dented section in such a manner that it comes outward being distant from the opening edge. Also, in this case, the portion close to the outer edge of the inserting end of the face body plastically deformed outward along the bottom section coming into contact with the bottom section of the recess of the head body, finally reaches a region (engaging section) close to the opening edge of the recess along the inclined section of the dented section in the process of plastic deformation. However, in the dented section which is first filled by the portion close to the outer edge of the inserting end of the plastically deformed face body, the inclined section continues from the region close to the bottom section to the opening end of the recess. Therefore, the region close to the bottom section in the dented section is filled with the portion close to the outer edge of the inserting end of the face body, which has been plastically deformed, by a far smaller quantity than that of the conventional example. Therefore, a larger quantity of the portion than that of the conventional example is introduced into the inclined section, and the residual region of the dented section is sufficiently filled.

Accordingly, in the portion close to the outer edge of the inserting end of the face body which enters the dented section being press-fitted into the head body and plastically deformed along the bottom section of the recess, the probability of occurrence of blow holes can be decreased as compared with the conventional example. Accordingly, the engaging strength of the face body with the recess of the head body can be more enhanced than that of the conventional example, and further the manufacturing work can be simplified.

In the golf club head according to the present invention composed as described above, it is preferable that the inclined section of the dented section is composed of a linear inclined section.

It is easy to manufacture the aforementioned inclined surface.

In this connection, in the above recess, the inclined section coming inward in such a manner that it becomes thin as it comes to the rear surface of the head body, may be a recessed surface or a protruded surface or other surfaces of various shapes as long as the portion close to the outer edge of the inserting end of the plastically deformed face body can be introduced from the region close to the bottom section of the dented section to the engaging section so that the residual region of the dented section can be quickly and positively filled with the portion close to the outer edge of the inserting end of the plastically deformed face body.

In order to accomplish the above objects, the present invention is to provide a method of manufacturing a golf club head comprising the steps of: forming a dented section including an engaging section formed at least in a portion on the inner circumferential surface of a recess formed on a ball hitting surface of a face section of a metallic head body and also including an inclined section which is inclined inward as it comes to a rear surface of the head body; forming a bottom section protruding at a position closest to the rear surface of the head body inward with respect to the edge of the opening of the recess; and press-fitting the metallic face body into the recess while the face body is made to come into contact with the bottom section so as to plastically deform the face body along the bottom section and the inclined section of the dented section, so that the metallic face body can be engaged with the engaging section of the dented section.

In the method of manufacturing a golf club head according to the present invention described above, a portion close to the outer edge of the inserting end of the face body enters the dented section of the head body being plastically deformed along the bottom section of the head body. In the dented section, this portion close to the outer edge of the inserting end of the face body first fills a region close to the bottom section protruding to a position closest to the opening end of the recess. Then the portion close to the outer edge of the inserting end of the face body fills the residual region in the dented section to the engaging section while it comes outward so that it becomes distant from the opening edge as it comes to the opening edge of the recess along the inclined section of the dented section. The portion close to the outer edge of the inserting end of the face body, which has been plastically deformed outward when it comes into contact with the bottom section of the head body, finally reaches a region close to the opening edge of the recess along the inclined section in the process of plastic deformation, that is, the portion close to the outer edge of the inserting end of the face body finally reaches the engaging section. However, in the recess which is first filled with the plastically deformed portion close to the outer edge of the inserting end of the face body, the inclined section continues from the region close to the bottom section, to the engaging section closest to the opening edge of the recess. Therefore, this plastically deformed portion close to the outer edge of the inserting end of the face body fills the region close to the bottom section in the recess with a far smaller quantity than that of the conventional case. After that, this plastically deformed portion close to the outer edge of the inserting end of the face body, the quantity of which is far larger than that of the conventional example, is introduced to the inclined section, so that the residual region in the dented section to the engaging section can be sufficiently filled with it.

Accordingly, when this portion close to the outer edge of the inserting end of the face body is press-fitted into the recess of the head body, plastically deformed along the bottom of the recess and intruded into the recess, the probability of occurrence of blow holes in the dented section is far lower than that of the conventional case. For the above reasons, the engaging strength of the face body with the recess of the head body can be enhanced higher than the conventional case, and further the manufacturing process of the club head is not complicated.

In the method of manufacturing the golf club head according to the present invention composed as described above, it is preferable that the inclined section in the dented section is composed of a linear inclined surface.

It is easy to manufacture the aforementioned linear inclined surface.

In the method of manufacturing the golf club head according to the present invention composed as described above, it is preferable that the press-fitting means for press-fitting the face body into the recess gives a higher pressure to the peripheral portion of the face body than the pressure given to the residual portion of the face body.

Due to the foregoing, the plastically deformed portion close the outer edge of the inserting end of the face body fills the region close to the bottom section and then fills the residual region in the dented section quickly and positively with higher pressure. Accordingly, the engaging strength of the face body with the recess of the head body can be more enhanced.

DETAILED DESCRIPTION OF THE PREFERRED EMBODIMENT

Referring to the accompanying drawings, an embodiment of the present invention will be explained in detail below.

Figure 1:
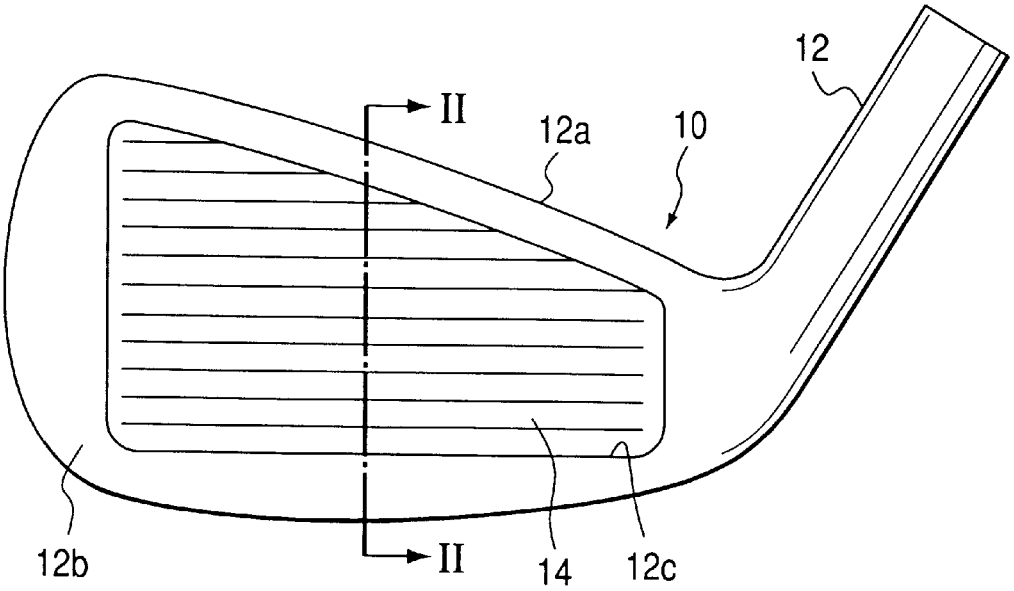
FIG. 1 is a front view of the golf club head according to one embodiment of the present invention.
Figure 2:
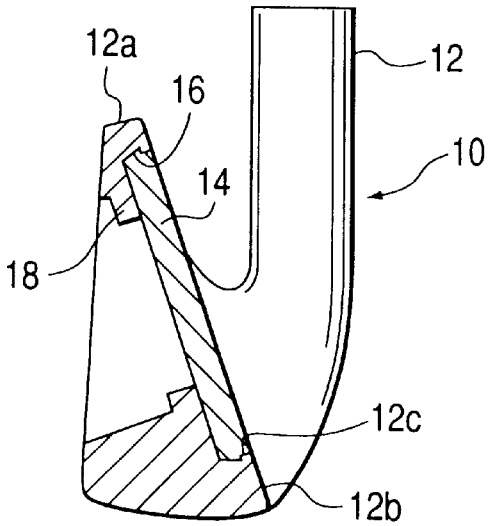
FIG. 2(A) is a transverse cross-sectional view of the golf club head taken on line II—II shown in FIG. 1.
FIG. 2(B) is an enlarged view showing a primary portion of FIG. 1(A).
Figure 2:
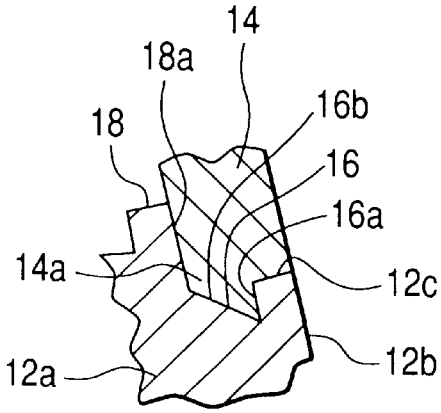

FIG. 1 is a front view of the golf club head according to the embodiment of the present invention. FIG. 2(A) is a transverse cross-sectional view of the golf club head taken on line II—II in FIG. 1. FIG. 2(B) is an enlarged view showing a primary portion of FIG. 2(A).

As shown in FIGS. 1 and 2(A), the golf club head 10 of the embodiment of the invention includes: a head body 12 made of metal; and a face body 14 press-fitted into the recess 12*c* formed on the ball hitting surface 12*b* of the face section 12*a* of the head body 12.

In this connection, in this embodiment, the recess 12*c* of the head body 12 penetrates from the ball hitting surface 12*b* of the head body 12 to the rear surface of the head body 12, however, the recess 12*c* of the head body 12 may not penetrate.

On the overall inner circumferential surface of the recess 12*c* of the head 12 of this embodiment, there is provided a dented section 16 including an engaging section formed in such a manner that the engaging section is once dented outward with respect to the edge of the opening of the recess 12*c*, the recess also including an inclined section which is inclined inward as it comes to a rear surface of the head body 12. In the dented section 16, there is provided a bottom section 18 protruding inward from the inner end of the inclined section located at a position closest to the rear surface of the head body 12 with respect to the edge of the opening of the recess.

Referring to FIG. 2(B), shapes of the dented section 16 and the bottom section 18 will be respectively explained in detail. In the dented section 16, there is provided a region having an engaging section which is once dented outward from the opening edge of the recess 12*c*. This region is directed in the opposite direction to the ball hitting surface 12*b* of the head body 1 and composed of an engaging surface 16*a* which is parallel with the ball hitting surface 12*b*. In this region in the dented section 16, there is provided an inclined region which comes inward as it comes to the rear surface of the head body 12. This inclined region is composed of a linear inclined surface 16*b*. At the bottom section 18, this region is arranged in the same direction as that of the ball hitting surface 12*b* of the head body 12. The region which faces the engaging surface 16*a* of the dented section 16 is composed of a receiving surface 18*a* which is parallel with the ball hitting surface 12*b*.

As shown in FIG. 2(B), the face body 14 is inserted and press-fitted into the recess 12*c* of the head body 14 while it comes into contact with the receiving surface 18*a* of the bottom section 18. Due to the foregoing, the portion 14*a* close to the outer edge of the inserting end is plastically deformed and protruded along the receiving surface 18*a* of the bottom section 18 of the recess 12*c* toward the dented section 16 located outward. In this way, the dented section 16 is filled with the portion 14*a* close to the outer edge of the inserting end to the engaging section along the inclined section. Therefore, the face body 14 is engaged with the engaging section and fixed to the recess 12*c*.

Figure 3:
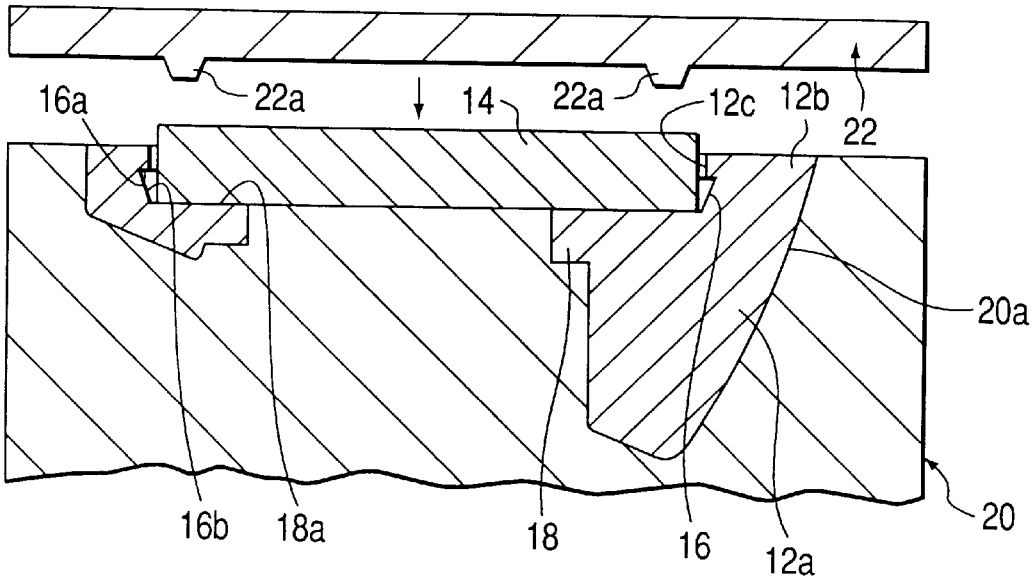
FIG. 3 is a transverse cross-sectional view showing a starting state of a portion of the manufacturing process of the golf club head shown in FIG. 1.
Figure 4:
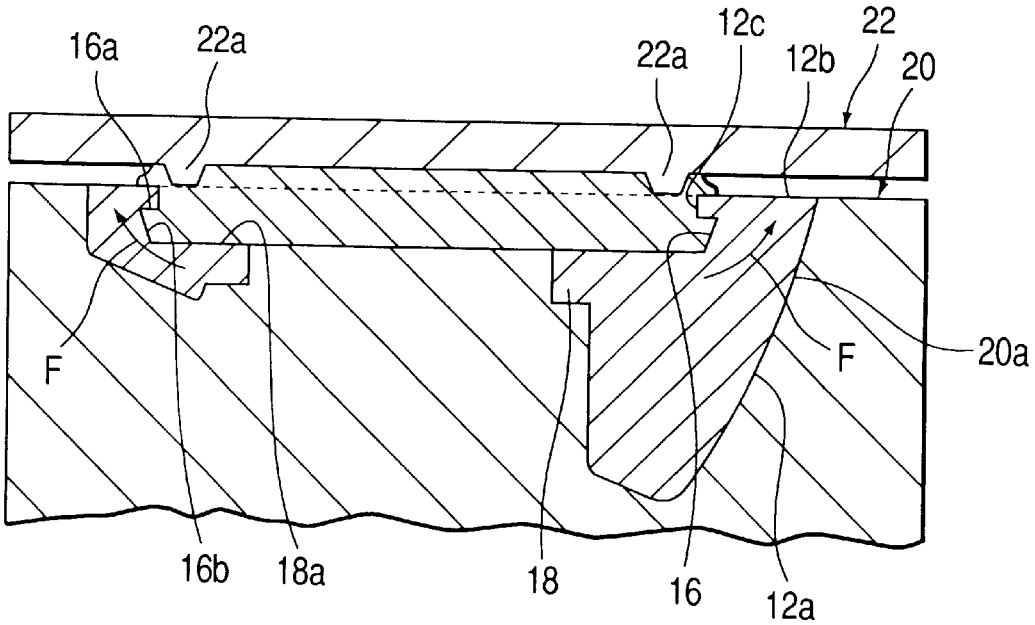
FIG. 4 is a transverse cross-sectional view showing an ending state of a portion of the manufacturing process of the golf club head shown in FIG. 3.

FIG. 3 is a transverse cross-sectional view showing a state in which a portion of the process of manufacturing the golf club head shown in FIG. 1 is started. FIG. 4 is a transverse cross-sectional view showing a state in which a portion of the process of manufacturing the golf club head shown in FIG. 3 is completed.

Next, referring to FIGS. 3 and 4, a method of manufacturing the golf club head shown in FIG. 1 will be explained in detail as follows.

On the ball hitting surface 12*b* of the face section 12*a* of the head body 12, there is previously formed a recess 12*c* which is formed together with the formation of the head body 12 or alternatively formed by means of machining conducted after the formation of the head body 12. Before the face body 14 is press-fitted into the recess 12*c*, on the inner circumferential surface of the recess 12*c*, there are formed a dented section 16, which has an engaging section and an inclined section, and a bottom section 18 as described before referring to FIGS. 2(A) and 2(B).

The head body 12, on the inner circumferential surface of the recess 12*c* of which the dented section 16 and the bottom section 18 are formed, is supported in the die recess 20*a* of the lower die 20 except for the ball hitting surface 12*b* and the recess 12*c* as shown in FIG. 3.

The flat surface shape and dimensions of the face body 14 are substantially the same as those of the opening edge of the recess 12*c*. Thickness of the face body 14 is larger than the depth of the recess 12*c* by a predetermined thickness. In this case, the depth of the recess 12*c* is a distance from the opening edge of the recess 12*c* to the receiving surface 18*a* of the bottom section 18.

As shown in FIG. 3, the thus prepared face body 14 is inserted into the recess 12*c*, and the portion close to the outer edge of the inserting end is made to come into contact with the receiving surface of the bottom section 18.

Then, the face body 14 is pressed by a press-fitting means, in this case, the face body 14 is pressed by the upper die 22, so that the face body 14 is made to come into contact with the receiving surface 18*a* of the bottom section 18 of the recess 12*c* of the head body 12.

In this embodiment, on the press surface of the press-fitting means 22 corresponding to the exposed end of the face body 14, there are provided forcible press protrusions 22*a* which protrude toward the exposed end of the face body 14 on the inner circumferential surface of the ball hitting surface 12*b* of the face section of the head body and the recess 12*c*. The volume of the forcible press protrusions 22*a* is larger than the volume of the dented section 16.

As shown in FIG. 4, when the face body 14 is pressed by the press surface of the press-fitting means 22, it is press-fitted into the recess 12*c* of the head body 12. The portion close to the outer edge of the inserting end of the face body 14 is pressed against the receiving surface 18*a* of the bottom section 18 with a very high pressure by the forcible press protrusions 22*a* of the press-fitting means 22. Therefore, the portion close to the outer edge of the inserting end of the face body 14 is easily and positively subjected to plastic deformation. Accordingly, the portion close to the outer edge of the inserting end of the face body 14 fills a region close to the bottom section 18 on the inclined surface 16*b* of the inclined section of the dented section 16 along the receiving surface 18*a* of the bottom section 18. After that, the portion close to the outer edge of the inserting end of the face body 14 fills the residual region of the dented section 16 to the engaging surface 16*a* while it comes to the opening edge of the recess along the inclined surface of the dented section 16 as it is directed outward being distant from the opening edge. In this way, the plastically deformed portion close to the outer edge of the inserting end of the face body 14 fills the dented section 16 along the inclined surface 16*b* of the inclined section of the dented section 16. These circumstances are shown by the arrows in the view.

The portion close to the outer edge of the inserting end of the face body 14 plastically deformed outward coming into contact with the receiving surface 18*a* of the bottom section 18 of the recess 12*c* of the head body 12, finally reaches an engaging surface 16*a* of the engaging section close to the opening edge of the recess 12*c* being guided by the inclined surface 16*b* of the inclined section in the dented section 16 in the process of plastic deformation. However, in the dented section 16 which is first filled by the portion close to the outer edge of the inserting end of the plastically deformed face body 14, a region close to the bottom section 18, that is, an inner end of the inclined surface 16*b* of the inclined section becomes thin toward the inside and protrudes to a position closest to the opening end of the recess 12*c*. Therefore, the region close to the bottom section 18 in the dented section 16 is filled with the portion close to the outer edge of the inserting end of the face body, which has been plastically deformed, by a far smaller quantity than that of the conventional example. Therefore, a larger quantity of the portion than that of the conventional example is introduced into the residual region of the dented section 16 along the inclined surface 16*b* of the inclined section, and the residual region of the dented section is sufficiently filled to the engaging surface 16*a* of the engaging section.

Accordingly, in the portion close to the outer edge of the inserting end of the face body 14 which is plastically deformed, the probability of occurrence of blow holes in the dented section 16 (especially on the engaging surface 16*a* of the engaging section) can be decreased as compared with the conventional example. Further, the engaging strength of the face body with the recess of the head body can be more enhanced than that of the conventional example, and furthermore the manufacturing work can be simplified.

A portion of the exposed end of the face body 14 engaged with the recess 12*c* of the head body 12 is protruded from the recess 12*c* as shown in FIG. 4. This protruding portion, that is, the portion protruding outward from the ball hitting surface 12*b* is finally ground to the same level as that of the ball hitting surface 12*b* as shown by a dotted line in FIG. 4.

As described above in detail, according to the golf club head and the method of manufacturing the golf club head of the present invention, when the portion close to the outer edge of the inserting end of the face body is press-fitted into the recess of the head body, the probability of occurrence of blow holes caused in the dented section formed in the recess is lower than that of the conventional case. Accordingly, the engaging strength of the face body with the recess of the head body can be more enhanced than that of the conventional case. Further, it is easy to manufacture the golf club head of the invention.

What is claimed is:

1. A golf club head in which a recess is formed on a ball hitting surface of a face section of a metallic head body and a metallic face body is press-fitted into the recess, the golf club head comprising:

a dented section formed at least partially in said head body, the dented section defined by:

an engaging section dented radially outward with respect to an inner circumferential surface of said recess;

an inclined section inclined radially inward and extending from said engaging surface towards a rear surface of the head body; and a bottom section located at a position closest to the rear surface of the head body, the bottom section protruding radially inward beyond said inner circumferential surface of said recess, wherein the face body has a portion plastically deformed in a solid state to extend along the bottom section and the inclined section during press-fitting into the recess thereby substantially filling said dented section and engaging the engaging section of the dented section to secure said face body to said head body.

2. A golf club head according to claim 1, wherein the inclined section in the dented section is constructed by a linear inclined surface.

3. A golf club head according to claim 1, wherein the engaging section and the inclined section are connected together at a first perimeter, the inclined section and the bottom section are connected together at a second perimeter, and the first perimeter is located outward relative to the second perimeter.

4. A golf club head according to claim 3, wherein the first perimeter is the most outward portion of the dented section.

5. A golf club head according to claim 1, wherein the engaging section is constructed by a planar surface that is oriented opposite from the ball hitting surface and that is substantially parallel to the ball hitting surface.

6. A golf club head according to claim 1, wherein the engaging section is located substantially at a midpoint of a depth of the recess.

7. A golf club head according to claim 1, wherein the face body has a protruded portion on an outer periphery thereof, the protruded portion being conformed in shape with the dented section.

8. A golf club head according to claim 1, wherein the bottom portion has a through hole communicating a backside of the head body.

9. A method of manufacturing a golf club head comprising the steps of:

forming a dented section at least partially on an inner circumferential surface of a recess formed on a ball hitting surface of a face section of a metallic head body dented outward with respect to an opening edge of the recess, an inclined section inclined inward extending towards a rear surface of the head body and a bottom section which is a portion of the dented section located at a position closest to the rear surface of the head body, and which protrudes inward beyond the opening edge of the recess; and press-fitting a solid metallic face body into the recess while the face body is made to come into contact with the bottom section so that the face body is plastically deformed to substantially fill said dented section wherein deformation of said face body propagates along the bottom section and continues to deform along the inclined section of the dented section until the face body is engaged with the engaging section.

10. A method of manufacturing a golf club head according to claim 9, wherein the step of press-fitting includes:

applying a stronger pressure to a peripheral portion of the face body than a pressure to the rest of the face body.

* * * * *